US005915485A

United States Patent [19]

McAtavey

[11] Patent Number: 5,915,485

[45] Date of Patent: Jun. 29, 1999

[54] SKI POST HOLE AUGER BIT

[76] Inventor: Dennis B. McAtavey, 34 Mt. Vernon St., Dover, N.H. 03820

[21] Appl. No.: 08/782,921

[22] Filed: Jan. 13, 1997

[51] Int. Cl.[6] ..... E21B 10/44

[52] U.S. Cl. ..... 175/18; 175/323; 175/394

[58] Field of Search ..... 175/18, 323, 394, 175/414, 415, 417, 418, 213; 408/230

[56] References Cited

U.S. PATENT DOCUMENTS

| | | | |
|---|---|---|---|
| 2,339,104 | 1/1944 | Phipps | 175/421 |
| 2,614,814 | 10/1952 | Jones et al. | 175/421 |
| 3,854,727 | 12/1974 | Alexander . | |
| 4,488,605 | 12/1984 | Ruppel et al. . | |
| 4,529,341 | 7/1985 | Greene . | |
| 4,579,180 | 4/1986 | Peetz et al. | 175/394 |
| 4,950,108 | 8/1990 | Roos | 408/230 |
| 4,967,855 | 11/1990 | Moser | 175/394 |
| 4,968,193 | 11/1990 | Chaconas et al. . | |
| 5,038,870 | 8/1991 | Kuronen | 175/18 |
| 5,096,344 | 3/1992 | Fischer | 175/323 |
| 5,244,319 | 9/1993 | Cochran . | |
| 5,265,688 | 11/1993 | Rumpp et al. | 175/394 |
| 5,399,051 | 3/1995 | Aken et al. | 408/230 |
| 5,403,130 | 4/1995 | Moser et al. | 175/323 |

FOREIGN PATENT DOCUMENTS

| | | | |
|---|---|---|---|
| 41282 | 6/1969 | Finland | 175/18 |
| 373642 | 11/1935 | Germany | 175/394 |
| 2152127 | 4/1973 | Germany | 175/394 |

*Primary Examiner*—Hoang C. Dang
*Attorney, Agent, or Firm*—O'Connell Law Firm

[57] ABSTRACT

An auger bit for boring ski post holes having an elongated shank with a drill head fixed at a first end of the shank. The preferred drill head has diametrically opposed first and second open chip mouths, each defined by an advancing face and a trailing face of the drill head. The advancing face of the drill head may be oriented at a vertical rake angle and at a radial advance angle for propelling debris proximally from the drill head into and through the first and second chip mouths into first and second chip throats. The bit may include first and second excavating helices wound around the shank for a given number of rotations each at a given helix angle whereby first and second chip throats are formed. The second excavating helix may wind around the shank for a lesser number of rotations than does the first whereby a unitary chip throat succeeds the first and second chip throats. Preferably, the bit has an overall length greater than about fifteen inches and a shank which is hollow. The shank and helices may be made from titanium, and a cutting tip of the drill head may be made from tungsten carbide. The bit may be coated with Teflon.

16 Claims, 2 Drawing Sheets

SKI POST HOLE AUGER BIT

FIELD OF THE INVENTION

The present invention relates to boring tools. More particularly, it relates to an auger bit for boring ski post holes.

BACKGROUND OF THE INVENTION

Ski posts can be located along the terrain of a ski mountain to serve a variety of purposes. For example, the elongated shafts can retain signs to warn of danger, and they can mark the course of a slalom race. Ski mountain personnel normally must use boring tools to bore sufficiently deep holes in the snow and ice to accommodate the ski posts. Since electrical outlets generally are not available on the mountain, drill bits must be rotated by cordless hand drills.

Bits presently employed for boring ski post holes suffer from a number of marked deficiencies. Often, the bits are borrowed from other arts, and, as such, they are ill-suited to the present task. Considering first the cutting head of the drill, bits from different arts have drill heads of far less than an optimum configuration for boring in the unique materials of snow and ice. Improper drill heads exhibit poor cutting action. For example, workers often bore ski post holes with hammer drill bits that are intended to be used on masonry and the like where the workpiece material is to be pulverized with a hammer action. These bits crush the snow and push it out of the way more than they cut it and excavate it from the hole. Other bits, such as ship augurs, dull too quickly. With regard to the effective length of the bits, most bits taken from different fields are not long enough to permit a worker to bore a sufficiently deep hole without bending over very far or kneeling. Although this may be permissible in many other applications, it is unacceptable in boring ski post holes since the actor often is wearing ski boots the rigidity of which does not readily permit bending or crouching and since many holes may must be drilled in rapid succession (i.e., in a slalom race where flags have been knocked over or the course is to be rearranged). With regard to the excavation helices of alternative-art bits, by their very nature they are intended to excavate different materials than snow and ice. As such, they have been found to clog and demonstrate poor excavation characteristics. This is particularly the case when snow is wet and sticky as in the springtime. Also, the excavation helices or prior art bits exhibit excessive resistance to rotation in the bore hole. Further still and likely of greatest importance, bits taken from other arts tend to be unsuitable for field use with cordless drills, particularly when one seeks to bore ski post holes. Due to excessive weight, disadvantageous head or helix design, or unsuitable material selection, the drill bits have been found to wear the cordless drill batteries rapidly, to require excess effort to carry and use, and, most importantly, to overload and to damage cordless drill mechanisms. Such damage to the drills results in excess expense in the form of down time and drill repair or replacement.

Naturally, the obvious deficiencies exhibited by alternative-art bits have prompted attempts to provide modified or specifically-adapted bits. Unfortunately, as one problem has been addressed, other difficulties have been created, exacerbated, or ignored. Some recognized that the prior art bits were too short, so they sought or created longer bits or provided extensions for present bits. However, resulting bits have proven to be too heavy for a cordless drill, and damage and wear problems have increased. Also, the length of the bits has made them vulnerable to bending and breaking.

Some bits have been provided which are lighter, but these have demonstrated undesirable warping tendencies even when constructed of relatively short length. In sum, it has been observed that whenever one deficiency such as length, weight, strength, cutting ability, excavation ability, or durability has been addressed, one or more other problems has been worsened or left untouched; achieving a simultaneous balance of desirable characteristics has proven unattainable thus far.

In light of the above, it becomes clear that there is a true need for a bit specifically adapted for boring ski post holes which bores well through snow, ice and earth, is sufficiently long for its purpose, exhibits exemplary debris excavation characteristics over a variety of conditions, and presents minimal peripheral resistance to rotation—all while being strong, durable, and lightweight.

SUMMARY OF THE INVENTION

Advantageously, the present invention provides an auger bit specifically adapted for boring ski post holes that is long yet lightweight, durable and strong, bores well through snow, ice, and earth while excavating debris efficiently, and rotates with minimal resistance as it bores a hole. From this specification, these and other advantages of the present invention will become obvious to those skilled in the art.

In accomplishing its objects, the present invention essentially comprises an auger bit for boring ski post holes including an elongated shank with a first end, a second end, and an axis of rotation. A drill head is fixed at the first end of the shank, a first excavating helix is wound around the shank, and a tool engaging portion is fixed at the second end of the shank. The drill head has a cutting lip defined by an intersection of an advancing face and a tip face. It also has a first open chip mouth which is defined by an advancing face and a trailing face of the drill head. The first excavating helix has a leading end that is substantially contiguous with the first open chip mouth of the drill head and is wound around the shank for a given number of rotations at a given helix angle to create a first chip throat.

A number of preferred characteristics permit the present auger bit to meet the multiple needs left by the prior art. In view of the now-recognized need for a longer bit, the instant bit should be greater than about fifteen inches in length, preferably greater than about twenty inches in length, and most optimally between twenty-five and thirty inches in length. To compensate for the additional weight which such an advantageous length would otherwise present, the shank of the bit may be hollow. To eliminate undesirable bending, breaking, and wearing of such a long bit and to lighten the bit still further, a structural material should be chosen for the shank and, ideally, the helix too that has an exceptionally high strength-to-weight ratio. Most optimally, this material may be alloyed or unalloyed titanium since these are known to have the highest strength-to-weight ratio of any structural metal. It has been found that, with the shaft and helix crafted from titanium, even a hollow shank bit over twenty-five inches long is nearly impossible to bend or otherwise damage.

Other improvements make for a still more marked advance over the prior art. Coating the bit with a tetrafluoroethylene such as the material commonly sold under the trademark Teflon by Du Pont has been found to give a multiplicity of favorable results. The coating's tendency to reduce the coefficient of friction of the bit reduces the bit's peripheral resistance to radial motion. As a result wear on cordless drills is reduced. The coating also improves the excavation characteristics of the chip mouth and throat. This is particularly prevalent in conditions of wet and sticky snow and slush.

Improvements in the drill head improve the auger bit's performance yet further. As was mentioned above, prior art bits demonstrate difficulty in boring efficiently through snow and ice. With this in mind, the present bit preferably provides a drill head with an advancing face having a vertical rake angle. As a result, the advancing face approaches and cuts into the work material at an obtuse angle. This leads to at least two advantageous results: the drill head is pulled into a post hole bore by a vertical component of the radial cutting force, and the debris severed by the cutting lip tends to be directed proximally from the cutting lip into and through the open chip mouth. Naturally, a preferable, diametrically-opposed, and symmetrical second open chip mouth improves the bit's performance even further. Still further, the advancing face of the chip mouth may be disposed at a radial advance angle which causes debris cut away by the cutting lip to be directed radially inward toward the axis of rotation of the bit. Cumulatively, the vertical rake angle and the radial advance angle vigorously direct the debris out of the chip mouth and into the chip throat for excavation from the post hole by the excavation helix structure.

Where there are two drill heads, a novel double helix structure also results in a number of performance benefits. A traditional double helix structure might excavate debris well when other features of the invention are employed. Nonetheless, further advantages are derived by employing a helix formation wherein a second helix, diametrically-opposed and symmetrical to a first helix, winds around the shank a lesser number of times than does the first helix. Under such an arrangement, a unitary chip throat follows first and second individual chip throats. With debris already following a helical axial path, removing one helix improves excavation by reducing obstruction and increasing available volume. Furthermore, eliminating one helix over a substantial portion of the shank produces the tripartite result of reducing the weight of the bit, lessening the bit's peripheral resistance to rotation, and reducing the rotational inertia of the bit all while improving its ability to excavate debris.

Taken together, the many improvements disclosed by the present invention permit the invented drill bit to spin more easily, excavation to be carried out more effectively, the drill to experience less demand and damage, and post holes to be bored more easily and rapidly.

The foregoing discussion broadly outlines the more important features of the invention to enable a better understanding of the detailed description that follows and to instill a better appreciation of the invention's contribution to the art. Before an embodiment of the invention is explained in detail, it must be made clear that the following details of construction, descriptions of geometry, and illustrations of inventive concepts are mere examples of possible manifestations of the invention.

DETAILED DESCRIPTION OF A PREFERRED EMBODIMENT

Figure 1:
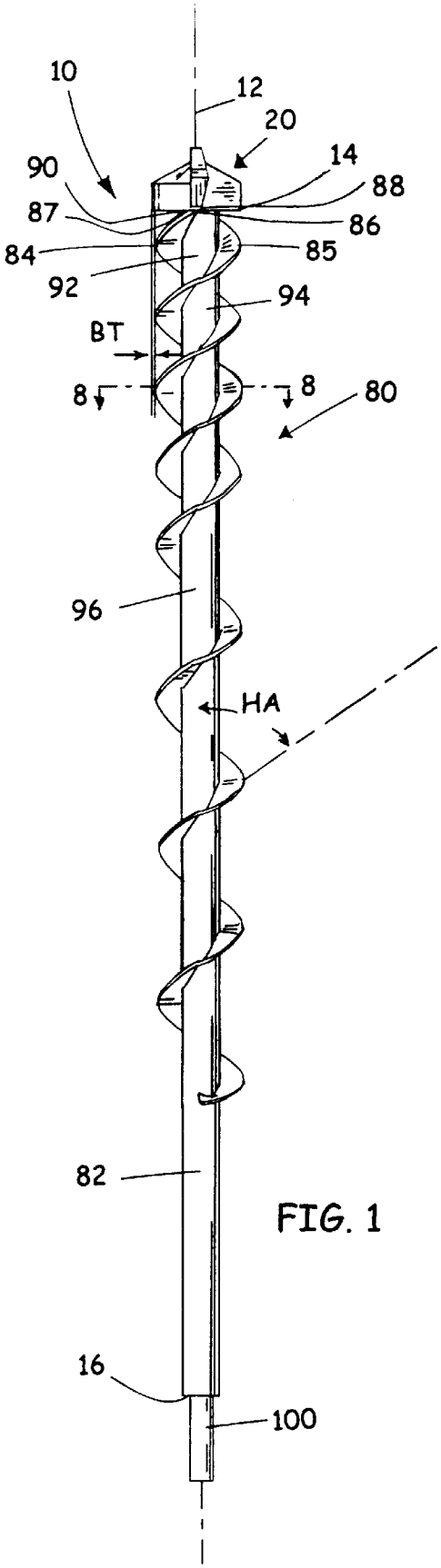
FIG. 1 is a view in side elevation of a ski post hole auger bit according to the present invention.

In the accompanying description and in the included drawings, reference characters are applied as is shown below.

10 ski post hole auger bit
12 axis of rotation
14 first end
16 second end
20 drill head
22 head base
24 support cone section
26 base platform
28 perimeter surface
30 lip relief surface
32 support surface
34 trailing face
40 cutting tip
42 cutting face
44 apex line
46 cutting lip
48 advancing face
52 scraping edge
54 radial face
56 supported face
58 first open chip mouth
60 second open chip mouth
62 advancing face plane
64 reference radius
80 drill body
82 shank
84 first excavating helix
85 second excavating helix
86 first excavating helix leading end
87 second excavating helix leading end
88 first lead terminus
90 second lead terminus
92 first chip throat
94 second chip throat
96 unitary chip throat
100 tool engaging portion
PA point angle
AA radial advance angle
RA vertical rake angle
HA helix angle
BT back taper Referring to FIG. 1 in more detail, there is shown a preferred embodiment of a ski post hole auger bit 10 according to the present invention. Most basically, the bit 10 has an axis of rotation 12, a drill head 20, a drill body 80, and a tool engaging portion 100. Although the drill head 20 and the tool engaging portion 100 ultimately may be formed unitarily with the drill body 80, the bit 10 currently is best made by welding the drill head 20 to a first end 14 of the shank 82 and welding the tool engaging portion 100 to the second end 16 of the shank 82.

Figure 2:
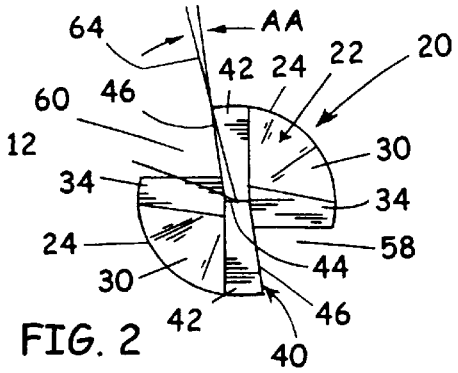
FIG. 2 is an end view of a drill head according to the present invention.
Figure 3:
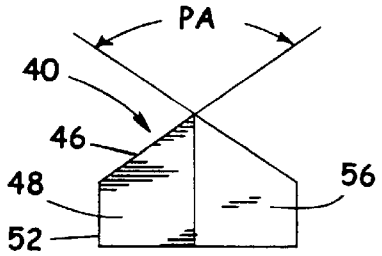
FIG. 3 is a front elevation view of a cutting tip according to the present invention.
Figure 4:
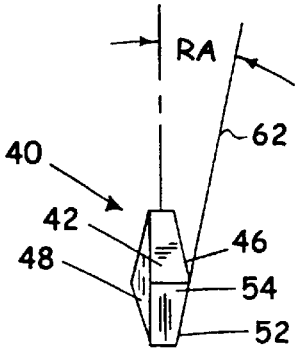
FIG. 4 is a side elevation view of a cutting tip according to the present invention.
Figure 5:
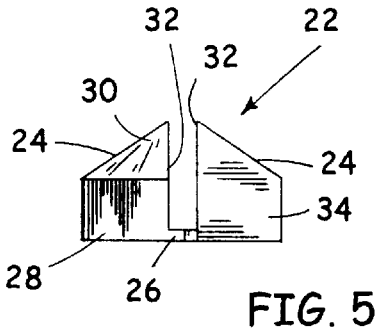
FIG. 5 is a front elevation view of a head base according to the present invention.

Turning to FIG. 2, one sees that the drill head 20 is formed by the joined structures of a head base 22 and a cutting tip 40. In the presently-preferred embodiment, the head base 22 essentially acts as a support for the cutting tip 40. As FIGS. 2 and 5 show, the head base 22 is comprised of two diametrially-opposed and symmetrical support cone sections 24 fixed on a generally X-shaped base platform 26. Each support cone section 24 has an arcuate perimeter surface 28, a lip relief surface 30, a support surface 32, and a trailing face 34. Looking next to FIGS. 3 and 4, it is shown that the cutting tip 40 is symmetrically formed with mutually-opposing elements. Each half of the tip 40 has an advancing face 48, a cutting face 42, a radial face 54, and a supported face 56. The cutting faces 42 of the tip 40 intersect at a point angle PA to define an apex line 44. The point angle PA presently is preferred to range between 80 degrees and 140 degrees with 110 degrees seen as most optimum. The respective advancing faces 48 and the cutting faces 42 intersect to define cutting lips 46. In turn, advancing faces 48 and radial faces 54 intersect to define scraping edges 52. For enhanced cutting and durability, in the preferred embodiment of the invention the cutting tip 40 is made from tungsten carbide and is ground to shape and brazed into place on the head base 22.

Looking to FIGS. 1 and 2, it is shown that a preferred drill head 20 includes a first open chip mouth 58 diametrically-opposed and symmetrical to a second open chip mouth 60 wherein each open chip mouth 58 and 60 is formed between an advancing face 48 of the cutting tip 40 and a trailing face 34 of a head base 22. FIG. 2 also shows that in a much preferred embodiment each advancing face 48 is disposed at a radial advance angle AA that is formed between a plane 62 of the advancing face 48 and a reference radius 64 extending from the axis of rotation 12 of the bit 10. Due to the radial advance angle AA, each advancing face 48 tends to direct debris radially inward toward the axis of rotation 12 of the bit 10. Although a wide range of radial advance angles AA would serve the inventive purpose, between five degrees and ten degrees has been found to be preferable with approximately seven degrees being most preferred. In addition, FIG. 4 illustrates that each advancing face 48 is disposed at a vertical rake angle RA that is formed between the plane 62 of the advancing face 48 and the axis of rotation 12 of the bit 10. The effect of the vertical rake angle RA is to direct debris cut by the cutting lips 46 proximally toward the drill body 80. As with the radial advance angle AA, a wide range of angles may be effective, but a vertical rake angle RA between ten degrees and twenty degrees is desired with approximately thirteen degrees believed to be most advantageous. Cumulatively, the radial advance angle AA and the vertical rake angle RA tend to propel debris cut by the cutting lips 46 into and through the open chip mouths 58 and 60.

Referring to FIG. 1, from the open chip mouths 58 and 60, debris is propelled unavoidably into the drill body 80. Snow and ice from first open chip mouth 58 is guided into first chip throat 92 which is helically defined with first excavating helix 84, which initiates substantially contiguously with first lead terminus 88 of first open chip mouth 58, as its lower boundary and second excavating helix 85, which initiates substantially contiguously with second lead terminus 90 of second open chip mouth 60, as its upper boundary. Snow and ice from second open chip mouth 60 is guided into second chip throat 94 which is helically defined with second excavating helix 85 as its lower boundary and first excavating helix 84 as its upper boundary. First and second excavating helices 84 and 85 wind around shank 82 at substantially equal helix angles HA. Presently, it is preferred that the helix angles HA range between thirty-five and sixty degrees with approximately 48 degrees being most preferred. FIG. 1 shows that second excavating helix 85 winds around shank 82 a lesser number of rotations than does first excavating helix 84 whereby unitary chip throat 96 succeeds first and second throats 92 and 94. Currently, it is preferred that second excavating helix 85 wind around shank 82 less than one-half of the number of times that first excavating helix 84 winds around shank 82. Most ideally, second excavating helix 85 winds around shank 82 approximately one-fourth of the number of times than does first excavating helix 84. As with the drill head 20 and the tool engaging portion 98, although the helices 84 and 85 ultimately may be formed integrally with the remainder of the bit 10, presently they are welded in place by means known in the art.

Naturally, the diameter of a bored hole will be determined substantially by the effective diameter of the drill head 20. Presently, it is contemplated that the drill head 20 may be created with such effective diameters of approximately 1.25 inches, 1.5 inches, 1.75 inches, 2 inches, and 1.18 inches (30 mm.). To reduce the peripheral resistance of the bit 10 due to friction, an amount of back taper shown as BT in FIG. 1 may be employed such that the helices 84 and 85 have a lesser effective diameter than the drill head 20. A back taper BT of between one and five percent has been found effective with about two and one-half percent being most preferred. For example, if a 1.25 inch diameter drill head 20 is employed, a back taper BT of approximately 0.03 inches would be satisfactory whereby the effective diameter of the helices 84 and 85 would be about 1.19 inches. With a 1.25 inch effective-diameter bit 10 crafted in a most-preferred manner, the shank 82 has an outside diameter of about 0.5 inches. To permit the bit 10 to be used with drills having relatively small chucks, the tool engaging portion 98 of the bit 10 may be reduced in diameter as compared to the shank 82.

Figure 8:
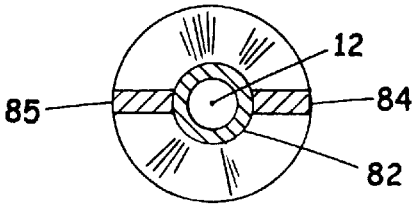
FIG. 8 is a cross-sectional view of the drill body taken along the line 8—8 in FIG. 1.

Since a relatively long bit 10 would permit users to bore ski post holes most conveniently and effectively, the bit 10 preferably has an overall length exceeding fifteen inches, more preferably has an overall length exceeding twenty inches, and most preferably has an overall length between twenty-five and thirty inches. Since weight is an important concern, a most preferred bit 10 has its shank 82 and helices 84 and 85 made from alloyed or unalloyed titanium material since it is know to possess an exceedingly high strength-to-weight ratio. As FIG. 8 depicts, the most preferred bit 10 has a shank 82 which is tubular, thus further lightening the bit. Also, the most ideal bit 10 is improved still further by its receipt of a coating of a tetrafluoroethylene material such as that commonly sold under the trademark Teflon by Du Pont.

Figure 6:
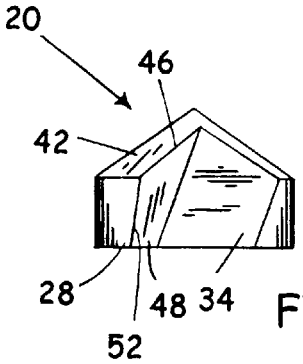
FIG. 6 is a front elevation view of an alternative drill head according to the present invention.
Figure 7:
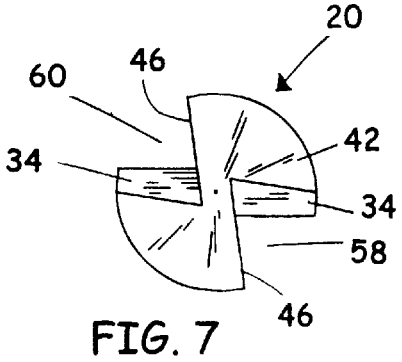
FIG. 7 is an end view of the drill head of FIG. 6.

FIGS. 6 and 7 show an alternatively-preferred drill head configuration indicated generally at 20. Employing identical reference characters, it is seen that the drill head 20 is of substantially unitary construction. It has first and second open chip mouths 58 and 60 defined by advancing faces 48 and trailing faces 34. Cutting lips 46 are defined by the intersection of advancing faces 48 with cutting faces 42, and scraping edges 52 are defined by the intersection of advancing faces 48 with perimeter surfaces 28. The drill head 20 may be formed integrally with the drill body 80, or it may be fixed thereto by such standard procedures as welding.

From the foregoing, it is apparent that the present invention has many advantages in consequence its being specially created to meet the unique needs presented by boring ski post holes into the terrain of a ski mountain. For example, the auger bit 10 is long enough that a user may drill a ski post hole of sufficient depth without excessive bending or crouching on the slippery surface in ski boots and the like. The bit 10 has been made lightweight yet strong by being made with a hollow shank 82, having a double-to-single helix 84 and 85 design, and having its shank 82 and helices 84 and 85 crafted from titanium. The bit 10 is durable due to its employing a tungsten carbide cutting tip 40 brazed into place in the drill head 20. The drill head 20 bores well through snow and ice, and debris is excavated exceedingly well due to the combined effects of the drill head's 20 employing a vertical rake angle RA and a radial advance angle AA and due to the unique design of the helices 84 and 85. Still further, the auger bit 10 may be rotated with minimal peripheral and inertial resistance as a result of the shank 82 being hollow, there being just one helix 84 for much of the length of the bit 10, and there being a back taper BT. Cumulatively, the advances revealed in the present invention markedly reduce the wear and damage inflicted on cordless drills used to rotate the bit 10 while making the boring of ski post holes less burdensome and more efficient.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

I claim as protected by United States Letters Patent:

1. An auger bit for boring ski post holes, the bit comprising:

an elongated shank with a first end, a second end, and an axis of rotation; a drill head fixed at the first end of the shank with a first open chip mouth and a second open chip mouth with each chip mouth defined by an advancing face and a trailing face of the drill head and each chip mouth with a cutting lip defined by an intersection of an advancing face and a cut face of the drill head wherein each advancing face is disposed at a radial advance angle formed between a plane of the advancing face and a reference radius extending from the axis of rotation of the bit whereby debris cut by a cutting lip tends to be directed radially inward toward the axis of rotation of the bit and wherein each advancing face is disposed at a vertical rake angle formed between the plane of the advancing face and the axis of rotation of the bit whereby the bit tends to be drawn into a post hole bore and debris cut by a cutting lip tends to be directed proximally from the cutting lip into and through the open chip mouth;

a first excavating helix with a leading end substantially contiguous with a lead terminus of the first chip mouth and wound around the shank for a given number of rotations at a given helix angle;

a second excavating helix with a leading end substantially contiguous with a lead terminus of the second chip mouth and wound around the shank at a helix angle substantially equal to the helix angle of the first excavating helix whereby a first chip throat is formed substantially contiguous with the first chip mouth and a second chip throat is formed substantially contiguous with the second chip mouth; and a tool engaging portion fixed at the second end of the shank; wherein substantially the entire bit is coated with Teflon.

2. The auger bit of claim 1 wherein the second excavating helix is wound around the shank for a lesser number of rotations than is the first excavating helix whereby a unitary chip throat is formed where the second excavating helix ends and the first excavating helix continues to wind around the shank.

3. The auger bit of claim 1 wherein the bit has an overall length greater than approximately 15 inches and the shank is tubular.

4. The auger bit of claim 3 wherein the shank is made with titanium.

5. The auger bit of claim 4 wherein the bit has an overall length greater than approximately twenty inches.

6. The auger bit of claim 4 wherein the excavating helix is made with titanium.

7. The auger bit of claim 1 wherein the bit has an overall length greater than about fifteen inches, the shank and the excavating helices are made with titanium, and the second excavating helix is wound around the shank for a lesser number of rotations than is the first excavating helix whereby a unitary chip throat is formed where the second excavating helix ends and the first excavating helix continues to wind around the shank.

8. An auger bit for boring ski post holes, the bit comprising:

an elongated, tubular shank with a first end, a second end, and an axis of rotation;

a drill head fixed at the first end of the shank comprised of a cutting tip fixedly retained and supported by a head base wherein the head base is comprised of two diametrically-opposed and symmetrical support cone sections fixed on a generally X-shaped base platform with each support cone section comprised of an arcuate perimeter surface, a lip relief surface, a support surface, and a trailing face, wherein the cutting tip is comprised of a pair of cutting faces intersecting at a given point angle generally at the axis of rotation of the bit thereby forming an apex line, a pair of diametrically-opposed and symmetrical cutting lips each defined by the intersection of an advancing face and a cutting face of the cutting tip, a pair of diametrically-opposed and symmetrical scraping edges each defined by the intersection of a radial face and an advancing face of the cutting tip, and a pair of diametrically-opposed and symmetrical supported faces each adjacent a support surface of the head base, wherein the drill head is further comprised of a first open chip mouth diametrically-opposed and symmetrical to a second open chip mouth with each chip mouth formed between an advancing face of the cutting tip and a trailing face of a support cone section, wherein each advancing face is disposed at a radial advance angle formed between a plane of the advancing face and a reference radius extending from the axis of rotation of the bit whereby debris cut by a cutting lip tends to be directed radially inward toward the axis of rotation of the bit, and wherein each advancing face is disposed at a vertical rake angle formed between the plane of the advancing face and the axis of rotation of the bit whereby the bit tends to be drawn into a post hole bore and debris cut by a cutting lip tends to be directed proximally from the cutting lip into and through an open chip mouth, a first excavating helix wound around the shank for a given number of rotations at a given helix angle and with a leading end substantially contiguous with a first lead terminus of the drill head;

a second excavating helix wound around the shank at a helix angle substantially equal to the helix angle of the first excavating helix and with a leading end substantially contiguous with a second lead terminus of the drill head whereby a first chip throat is formed substantially contiguous with the first open chip mouth of the drill head and a second chip throat is formed substantially contiguous with the second open chip mouth; and a tool engaging portion fixed at the second end of the shank.

9. The auger bit of claim 8 wherein the second excavating helix is wound around the shank for a lesser number of rotations than is the first excavating helix whereby a unitary chip throat is formed where the second excavating helix ends and the first excavating helix continues to wind around the shank.

10. The auger bit of claim 8 wherein the bit has an overall length greater than approximately 15 inches and the shank is tubular.

11. The auger bit of claim 10 wherein the shank is made with titanium.

12. The auger bit of claim 11 wherein the shank has an overall length greater than approximately twenty inches.

13. The auger bit of claim 12 wherein the first excavating helix is made with titanium.

14. The auger bit of claim 8 wherein the cutting tip is made with tungsten carbide.

15. The auger bit of claim 8 wherein substantially the entire bit is coated with Teflon.

16. The auger bit of claim 8 wherein the bit has an overall length greater than approximately fifteen inches, the shank and excavating helices are made with titanium, the cutting tip is made with tungsten carbide, substantially the entire bit is coated with Teflon, and the second excavating helix is wound around the shank for a lesser number of rotations than is the first excavating helix whereby a unitary chip throat is formed where the second excavating helix ends and the first excavating helix continues to wind around the shank.

* * * * *